US005605415A

United States Patent [19]

Shamblin

[11] Patent Number: 5,605,415

[45] Date of Patent: Feb. 25, 1997

[54] SCREED BAR ATTACHMENT

[75] Inventor: Larry Shamblin, Porum, Okla.

[73] Assignee: Michael A. Marshall, Stigler, Okla.

[21] Appl. No.: 543,609

[22] Filed: Oct. 16, 1995

Related U.S. Application Data

[63] Continuation-in-part of Ser. No. 452,662, May 25, 1995.

[51] Int. Cl.[6] ..... E01C 19/22

[52] U.S. Cl. ..... 404/118; 404/97; 15/235.8

[58] Field of Search ..... 404/101, 118, 404/119, 96, 97; 15/235.4, 235.5, 235.8, 245

[56] References Cited

U.S. PATENT DOCUMENTS

| | | | |
|---|---|---|---|
| 947,469 | 1/1910 | Gorden | 15/235.5 |
| 988,457 | 4/1911 | Glasscock | 404/97 X |
| 2,586,472 | 2/1952 | McKown | 404/97 X |
| 2,897,735 | 8/1959 | Alessio . | |
| 3,046,856 | 7/1962 | Baxter . | |
| 4,256,416 | 3/1981 | Bishop . | |
| 4,449,845 | 5/1984 | Carillo | 404/97 X |
| 4,641,995 | 2/1987 | Owens | 404/97 X |
| 4,702,641 | 10/1987 | Naser et al. . | |
| 4,828,427 | 5/1989 | Nisenbaum . | |
| 5,016,319 | 5/1991 | Stigen . | |

*Primary Examiner*—James A. Lisehora
*Attorney, Agent, or Firm*—William S. Dorman

[57] ABSTRACT

An attachment for a screed bar which is used to level concrete in concrete forms wherein the screed bar is operated by two individuals who place the bar on the concrete forms and then move it back and forth along the forms to level the concrete after it has been freshly poured into the forms, the attachment comprising an inverted U-shaped member attached adjacent each end of the screed bar, each member having a pair of parallel plates extending outwardly and upwardly therefrom at an angle of about 70° with respect to the vertical, a handle pivotally connected between each pair of parallel plates and extending outwardly and pivotally from each member, whereby the individuals can grasp the handles and move the screed bar over the forms and the concrete therein without having to stoop over.

1 Claim, 2 Drawing Sheets

SCREED BAR ATTACHMENT

CROSS-REFERENCE TO RELATED APPLICATIONS

This application is a continuation-in-part of prior application Ser. No. 08/452,662, filed on May 25, 1995 and entitled "Rod Handle Assembly".

BACKGROUND OF THE INVENTION

1. Field of the Invention

The present invention relates to a concrete screed board, and more particularly to a screed board attachment including a device for attaching a pair of pivotal handles to the screed board.

2. The Prior Art

As is known to those having ordinary skill in the art, a screed board is used in cement finishing work for leveling freshly poured concrete. If the area of the concrete to be smoothed is relatively narrow, a screed board, which is usually a relatively long, straight wooden board, may be operated by two individuals who place the board on concrete forms and then move it back and forth along the forms to level concrete after it has been freshly poured.

After concrete has been poured, care must be taken to level the concrete so that there are no high spots or low areas. When utilizing a screed board to accomplish this result, a screed board is selected which is generally 10 to 16 feet in length; the screed board is handled by men stooping over with their arms extended downwardly to grasp and move the screed board. As can be appreciated, this is a very tiring position, and many cement workers experience back problems as they grow older. It has been recognized that the use of handles in combination with a screed board may simplify the concrete levelling operation and thereby lessen the physical stresses on the operators of the screed board. However, none of the handles and similar proposals heretofore provided facilitated the operation of the screed board in the manner of the present invention.

A preliminary search was conducted on the present invention and the following listed patents were uncovered in the search.

| Patent No. | Inventor | Issue Date |
|---|---|---|
| 2,897,735 | Alessio | August 4, 1959 |
| 3,046,856 | Baxter | July 31, 1956 |
| 4,256,416 | Bishop | March, 1981 |
| 4,702,641 | Naser, et al. | October 27, 1987 |
| 4,828,427 | Nisenbaum | May 9, 1989 |
| 5,016,319 | Stigen | May 21, 1991 |

Bishop U.S. Pat. No. 4,256,416 shows a pair of short handles fixed relative to one another, one handle extending straight upwardly from its attachment to the screed bar while the other handle extends upwardly at an angle. Operation of the Bishop device requires applying a downward pressure on the upwardly extending handle while pulling the screed with the laterally outwardly extending handles. Furthermore, because of the shortness of the handles, the operators will still have to stoop over to operate the screed bar.

Naser, et al. U.S. Pat. No. 4,702,641 shows a single handle connected to the center of the screed bar by angled brackets.

Baxter U.S. Pat. No. 3,046,856 shows a concrete finishing device having a pivoted handle (see FIG. 4). However, the pivoting is accomplished in a different manner and could not be used on a screed bar with two men operating the screed bar as disclosed in the present application.

Alessio U.S. Pat. No. 2,897,735 describes a device attached to a screed and connected to a belt worn by the user with chains. The screed is moved side to side by the user swaying as he walks slowly backward. However, as can be appreciated from reviewing the Alessio disclosure, the construction of this handle assembly permits its use only on small jobs; i.e., with very short length screed boards inasmuch it is designed for use by only a single operator. Furthermore, it should be readily apparent from the description in the Alessio disclosure that the operation of this device would be extremely awkward.

Nisenbaum U.S. Pat. No. 4,828,427 shows an elongated handle with means of attachment to the screed board 14. Again, this patent does not disclose the present invention.

Stigen U.S. Pat. No. 5,016,319 shows an elongated telescoping handle which is not pivotal. The Stigen patent appears to be somewhat similar to the Bishop patent discussed above. The Bishop patent shows very short handles, whereas the Stigen patent shows longer handles inclined in essentially the same direction.

SUMMARY OF THE INVENTION

The present invention involves an attachment for a screed bar which is used to level concrete in concrete forms. The screed bar is operated by two individuals who place the bar on the concrete forms and then move it back and forth along the forms to level the concrete after it has been freshly poured into the forms. The attachment of the present invention comprises an inverted U-shaped member attached adjacent each end of the screed bar, each member having a pair of parallel plates extending outwardly and upwardly therefrom at an angle of about 70° with respect to the vertical. A handle is pivotally connected between each pair of parallel plates and extending outwardly and pivotally from each member, whereby the individuals can grasp the handles and move the screed bar over the forms and the concrete therein without having to stoop over.

The U-shaped attachment member of the present invention has an upper horizontal portion and a pair of left and fight vertical portions, each portion having a hole therethrough. The end of the lower parallel plate adjacent to the U-shaped member is also provided with a hole. Thus, a first a nail can be driven vertically and downwardly into the screed bar through the hole in the horizontal portion; a second nail can be driven horizontally into the screed bar through the hole in one of the vertical portions; and a third nail can be driven into the screed bar at an angle through the hole in the other of the vertical portions and through the hole in the lower parallel plate.

DETAILED DESCRIPTION OF THE PREFERRED EMBODIMENTS

Figure 1:
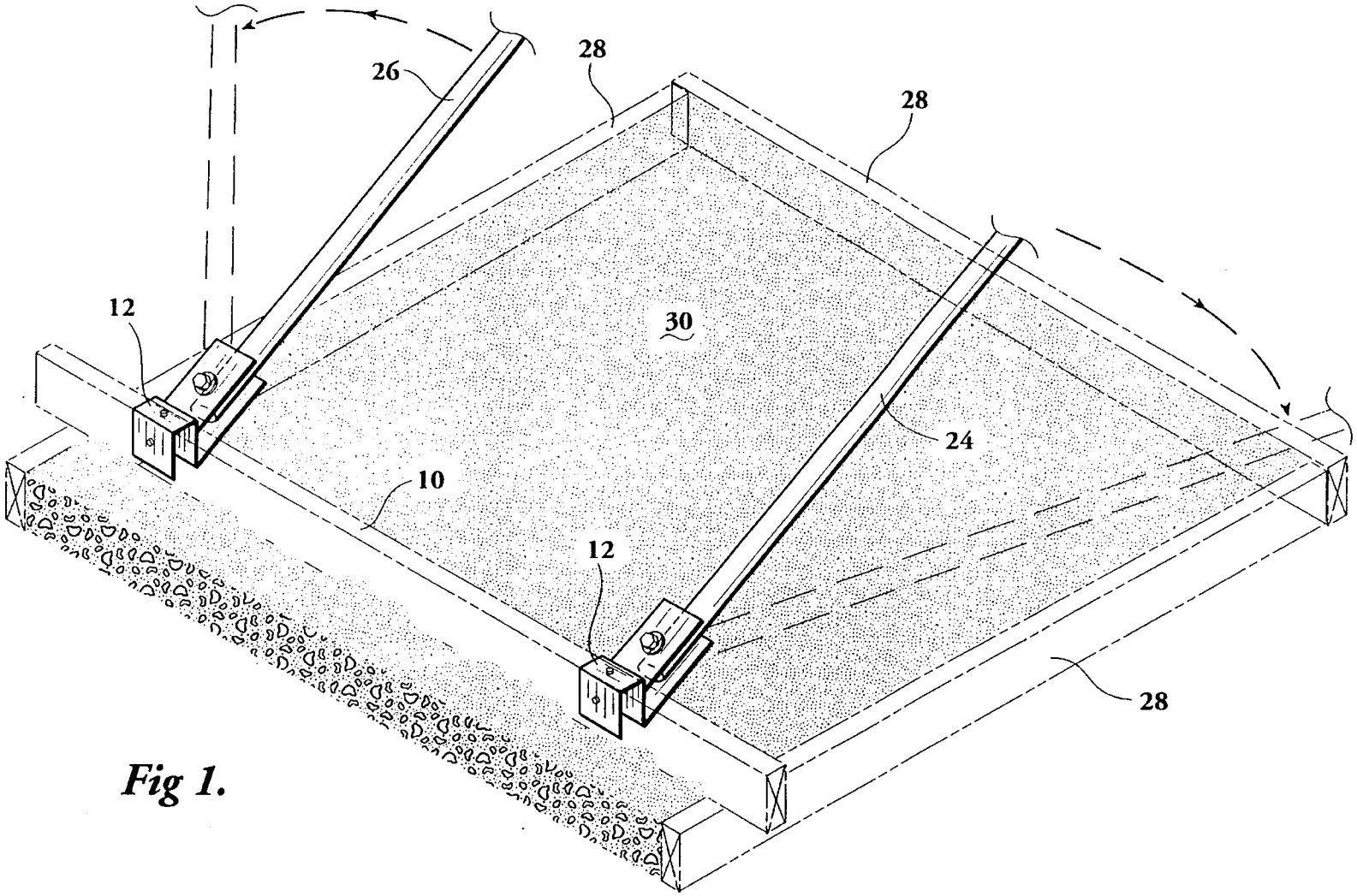
FIG. 1 is a perspective view of a screed bar positioned over concrete forms which enclose a quantity of freshly poured concrete; the screed bar attachments of the present invention are shown attached to the screed bar with pivotal handles extending outwardly therefrom.

Referring to the drawings in detail, FIG. 1 shows a screed bar 10 which is preferably made of wood extending eight to ten feet in length, depending upon the size of the concrete area to be levelled. The cross-sectional shape of the screed bar 10 can be that of a conventional "2 by 4", although any other similar cross-sectional shape will suffice. The screed bar 10 shows two attachments 12 of the present invention attached at spaced intervals, generally adjacent the ends of the screed bar. A more complete description of the attachment will appear hereinafter. The screed bar is shown as positioned over concrete forms 28 into which a body of concrete 30 has been freshly poured. A pair of wooden handles 24 and 26, preferably about five feet in length, extend outwardly and pivotally from the attachments 12. In order to manipulate the screed bar 10 over the concrete 30, two men (not shown) would be required. Each man would grip a handle 24 or 26 and the men would work in unison.

Figure 2:
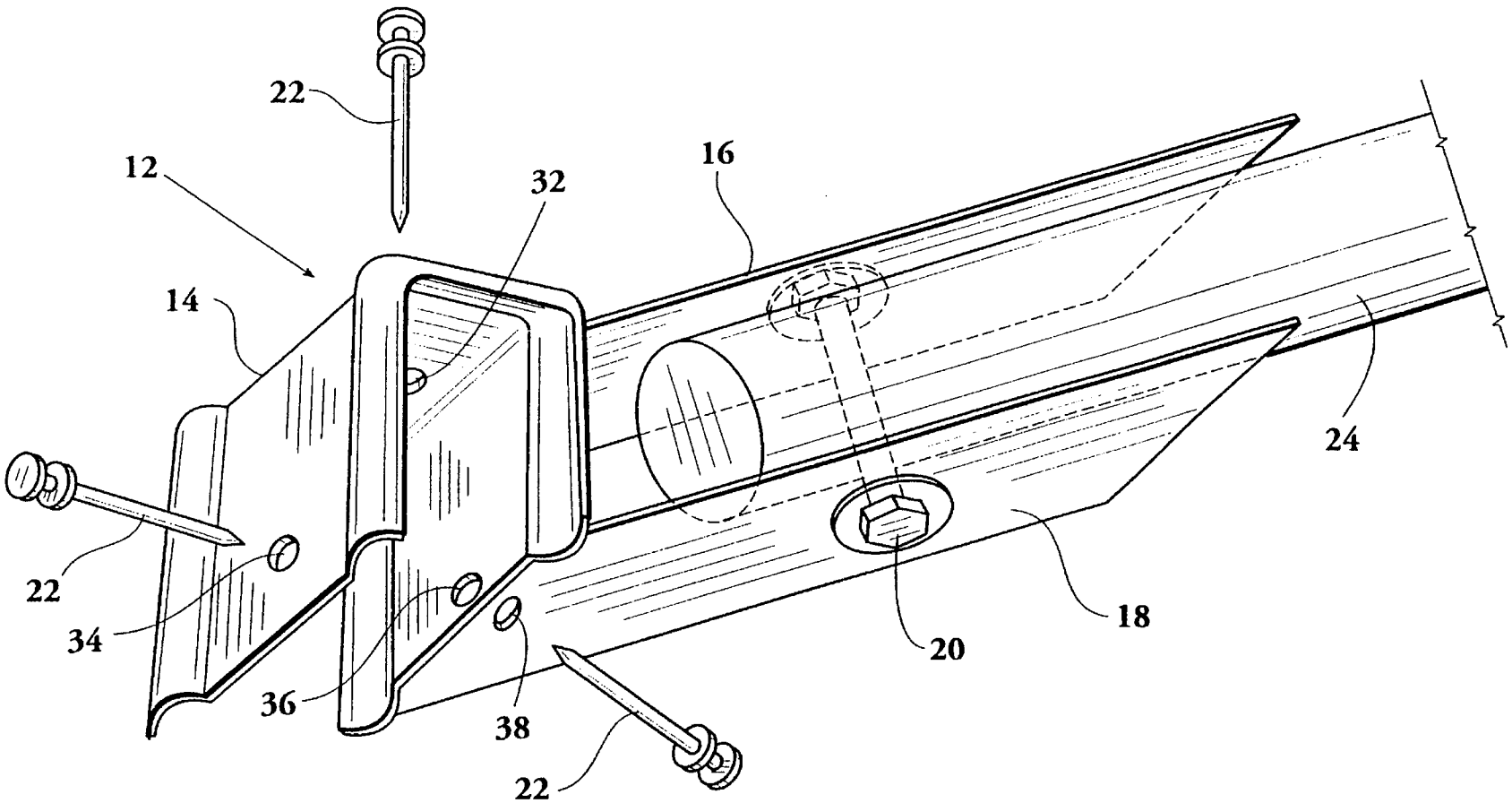
FIG. 2 is a perspective view of the screed bar attachment itself associated with one end of a pivotal handle.

As best shown in FIG. 2, each attachment 12 is formed from an inverted U-shaped member 14 having a pair of parallel plates 16 and 18 extending off at an angle of about 70° with respect to the vertical. These two plates 16 and 18 are parallel to each other and are provided with aligned holes (not referenced) through which a bolt 20 extends. The bolt 20 also passes through a hole (not referenced) in the handle 24 (or 26) which is in alignment with the holes referred to above in the plates 16 and 18. Thus, the handle 24 (or 26) can rotate approximately 180° between the two plates 16 and 18.

The screed bar assembly 10, including the attachments 12 and wooden handles 24 and 26, can be operated by two men (not shown) standing to the rear of the screed bar and who can operate the screed bar without having to stoop over, as would be the case with U.S. Pat. No. 4,256,416. Furthermore, the handles 24 and 26 can be swivelled through a total arc of approximately 180° .

FIG. 2 also shows the details of one manner of attaching the device 12 to the screed bar 10 of FIG. 1. A plurality of double-headed nails 22 are adapted to be driven through suitable holes in the U-shaped member 14 and in the lower plate 18 in a manner to be described hereinafter. The U-shaped member has an upper horizontal top portion (not referenced) which is provided with a hole 32 through which the upper double-headed nail 22 can be driven vertically and downwardly into the screed bar 10 (not shown in this Figure). The U-shaped member also has left and right vertical side portions (not referenced) which are provided with holes 34 and 36, respectively. The left-hand double-headed nail 22 shown in FIG. 2 can be driven through the hole 34 horizontally into the screed bar 10 (not shown in this Figure). With respect to the right-hand double-headed nail 22, the lower end of the right-hand side portion of the U-shaped member 14 is provided with the hole 36 as described above, whereas the lower and adjacent end of the plate 18 is provided with a hole 38. The right-hand double-headed nail 22 is thus driven through the holes 38 and 36 at an angle into the screed bar 10 (not shown in this Figure).

Whereas, the present invention has been described in particular relation to the drawings attached hereto, other and further modifications, apart from those shown or suggested herein, may be made within the spirit and scope of this invention.

What is claimed is:

1. A screeding apparatus for leveling concrete freshly poured within concrete forms by two individuals who place the apparatus on the concrete forms and then move the apparatus back and forth along the forms to level the concrete, said apparatus comprising:

a screed bar of rectangular cross-section having a first end and a second end;

a handle attachment secured to each end of said screed bar, each handle attachment including a three-sided U-shaped member and a pair of parallel plates extending outwardly and upwardly from said U-shaped member at an angle of about 70°, each U-shaped member having an upper horizontal top portion, a first vertical side portion, and a second vertical side portion, said first vertical side portion and said second vertical side portion each having an upper end attached to said upper horizontal top portion and a lower end remote from said upper horizontal top portion, wherein one of said parallel plates is attached to the lower end of said first vertical side portion, and wherein the other of said parallel plates is attached to said first vertical side portion between the lower end of the first vertical side portion and the upper end of the first vertical side portion;

means for attaching each handle attachment to said screed bar, said means each including a first fastener passing first through said one of said parallel plates, then through said first vertical side portion, and then into said screed bar; and a handle pivotally connected between the pair of parallel plates of each U-shaped member and extending outwardly from each said pair of parallel plates.

* * * * *